US009257750B2

(12) United States Patent
Vazquez et al.

(10) Patent No.: US 9,257,750 B2
(45) Date of Patent: Feb. 9, 2016

(54) ELECTRONIC DEVICE WITH MULTIBAND ANTENNA

(71) Applicant: Apple Inc., Cupertino, CA (US)

(72) Inventors: Enrique Ayala Vazquez, Watsonville, CA (US); Miroslav Samardzija, Mountain View, CA (US); Salih Yarga, Sunnyvale, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 262 days.

(21) Appl. No.: 13/895,194

(22) Filed: May 15, 2013

(65) Prior Publication Data

US 2014/0340265 A1 Nov. 20, 2014

(51) Int. Cl.

| | |
|---|---|
| ***H01Q 1/38*** | (2006.01) |
| ***H01Q 5/371*** | (2015.01) |
| ***H01Q 9/42*** | (2006.01) |

(52) U.S. Cl.

CPC ..... *H01Q 5/371* (2015.01); *H01Q 9/42* (2013.01); *H01Q 1/38* (2013.01)

(58) Field of Classification Search

USPC ..... 343/700 MS, 702

See application file for complete search history.

(56) References Cited

U.S. PATENT DOCUMENTS

| | | | | |
|---|---|---|---|---|
| 7,602,341 | B2 * | 10/2009 | Wei-Shan et al. | 343/700 MS |
| 7,719,470 | B2 | 5/2010 | Wang et al. | |
| 7,911,387 | B2 | 3/2011 | Hill et al. | |
| 8,159,394 | B2 | 4/2012 | Hayes et al. | |
| 8,432,322 | B2 | 4/2013 | Amm et al. | |
| 8,610,628 | B2 * | 12/2013 | Chen et al. | 343/700 MS |
| 8,760,348 | B2 * | 6/2014 | Huang et al. | 343/700 MS |
| 8,854,268 | B2 * | 10/2014 | Lin et al. | 343/702 |
| 2011/0012794 | A1 | 1/2011 | Schlub et al. | |
| 2011/0050509 | A1 | 3/2011 | Ayala Vazquez et al. | |
| 2012/0214412 | A1 | 8/2012 | Schlub et al. | |
| 2012/0223865 | A1 | 9/2012 | Li et al. | |
| 2012/0223866 | A1 | 9/2012 | Ayala Vazquez et al. | |
| 2013/0016013 | A1 | 1/2013 | Wong et al. | |

OTHER PUBLICATIONS

Yarga et al., U.S. Appl. No. 13/790,549, filed Mar. 8, 2013.
Jiang et al., U.S. Appl. No. 13/864,968, filed Apr. 17, 2013.
Schlub et al., U.S. Appl. No. 13/420,278, filed Mar. 14, 2012.
Zhu et al., U.S. Appl. No. 13/402,831, filed Feb. 22, 2012.

* cited by examiner

*Primary Examiner* — Tan Ho

(74) *Attorney, Agent, or Firm* — Treyz Law Group, P.C.; G. Victor Treyz; Michael H. Lyons

(57) ABSTRACT

An electronic device may have an antenna for providing coverage in wireless communications bands of interest. The wireless communications bands may include first, second, third, and fourth communications bands. The antenna may have an antenna resonating element with first, second, and third arms and may have an antenna ground. The antenna ground may be formed form metal housing structures and other conductive structures in the electronic device. The first arm may be configured to exhibit an antenna resonance in the first and third communications bands. The second arm may be configured to exhibit an antenna resonance in the second communications band. The third arm may be configured to exhibit an antenna resonance in the fourth communications band. The third arm may be located between the first arm and the ground. A diagonal crossover path may pass over a return path and may couple the second and third arms.

20 Claims, 11 Drawing Sheets

ELECTRONIC DEVICE WITH MULTIBAND ANTENNA

BACKGROUND

This relates generally to electronic devices, and, more particularly, to antennas in electronic devices.

Electronic devices such as portable computers and handheld electronic devices are often provided with wireless communications capabilities. For example, electronic devices may use long-range wireless communications circuitry to communicate using cellular telephone bands. Electronic devices may use short-range wireless communications links to handle communications with nearby equipment.

It can be difficult to incorporate antennas and electrical components successfully into an electronic device. Some electronic devices are manufactured with small form factors, so space is limited. In many electronic devices, the presence of conductive structures associated with components and housing structures can influence the performance of antennas. At the same time, it may be desirable for antennas to handle multiple communications bands. Configuring antennas to handle multiple communications bands can be challenging, particularly when antennas are mounted in an electronic device in close proximity to conductive structures such as housing structures and electrical components.

It would therefore be desirable to be able to provide improved antennas for handling multiple communications bands in electronic devices.

SUMMARY

An electronic device may have an antenna for providing coverage in wireless communications bands of interest. The wireless communications bands may include first, second, third, and fourth communications bands.

The antenna may have an inverted-F antenna resonating element with first, second, and third arms and may have an antenna ground. The antenna ground may be formed form metal housing structures and other conductive structures in the electronic device. The antenna resonating element may be formed form metal traces on a dielectric support structure such as a flexible printed circuit.

The first arm of the antenna resonating element may be configured to exhibit an antenna resonance in the first and third communications bands. The second arm may be configured to exhibit an antenna resonance in the second communications band. The third arm may be configured to exhibit an antenna resonance in the fourth communications band. The third arm may be located between the first arm and the ground. An electrical component such as a capacitor may be coupled between a tip portion of the first arm and the antenna ground. During operation, the first arm resonates in the first and third communications bands, the second arm resonates in the second communications band, and/or the third arm resonates in the fourth communications band.

The antenna may have an antenna feed coupled to a transmission line. The antenna feed may have a positive antenna feed terminal that is coupled to the third arm and a ground antenna feed coupled to the antenna ground. A return path may couple the antenna resonating element to the antenna ground. A crossover path may pass over the return path at a non-perpendicular angle without contacting the return path. The crossover path may have a first end that is coupled to the second arm and an opposing second end that is coupled to the third arm. The crossover path and antenna resonating element structures may be formed using multiple layers of metal traces on the flexible printed circuit substrate. A proximity sensor may be implemented using a capacitive proximity sensor electrode that is supported by the flexible printed circuit substrate.

Further features of the invention, its nature and various advantages will be more apparent from the accompanying drawings and the following detailed description of the preferred embodiments.

DETAILED DESCRIPTION

Figure 1:
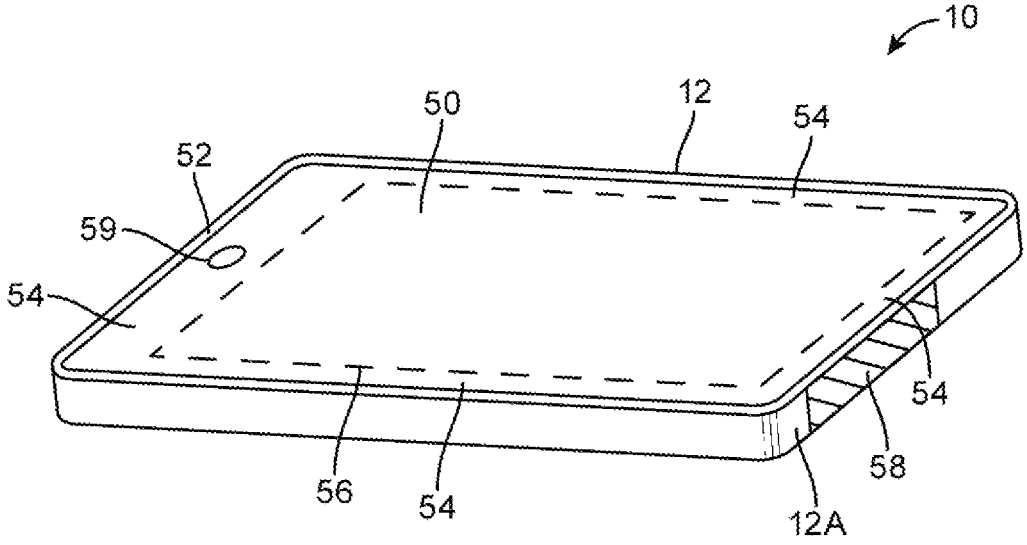
FIG. 1 is a front perspective view of an illustrative electronic device of the type that may be provided with antenna structures in accordance with an embodiment of the present invention.

An illustrative wireless electronic device with antenna structures is shown in FIG. 1. As shown in FIG. 1, device 10 may have a display such as display 50. Display 50 may be mounted on a front (top) surface of device 10 or may be mounted elsewhere in device 10. Device 10 may have a housing such as housing 12. Housing 12 may have curved, angled, or vertical sidewall portions that form the edges of device 10 and a relatively planar portion that forms the rear surface of device 10 (as an example). Housing 12 may also have other shapes, if desired.

Housing 12 may be formed from conductive materials such as metal (e.g., aluminum, stainless steel, etc.), carbon-fiber composite material or other fiber-based composites, glass, ceramic, plastic, or other materials. A radio-frequency-transparent window such as window 58 may be formed in housing 12 (e.g., in a configuration in which the rest of housing 12 is formed from conductive structures). Window 58 may be formed from plastic, glass, ceramic, or other dielectric material. Antenna structures, and, if desired, proximity sensor structures for use in determining whether external objects are present in the vicinity of the antenna structures may be formed in the vicinity of window 58. If desired, antenna structures and proximity sensor structures that are formed adjacent to the antenna structures or as part of the antenna structures may be mounted behind a dielectric portion of housing 12 (e.g., in a configuration in which housing 12 is formed from plastic or other dielectric material).

Device 10 may have user input-output devices such as button 59. Display 50 may be a touch screen display that is used in gathering user touch input. The surface of display 50 may be covered using a display cover layer such as a planar cover glass member or a clear layer of plastic. The central portion of display 50 (shown as region 56 in FIG. 1) may be an active region that displays images and that is sensitive to touch input. Peripheral portions of display 50 such as region 54 may form an inactive region that is free from touch sensor electrodes and that does not display images.

An opaque masking layer such as opaque ink or plastic may be placed on the underside of display 50 in peripheral region 54 (e.g., on the underside of the display cover layer). This layer may be transparent to radio-frequency signals. The conductive touch sensor electrodes and display pixel structures and other conductive structures in region 56 tend to block radio-frequency signals. However, radio-frequency signals may pass through the display cover layer (e.g., through a cover glass layer) and opaque masking layer in inactive display region 54 (as an example). Radio-frequency signals may also pass through antenna window 58 or dielectric housing walls in a housing formed from dielectric material. Lower-frequency electromagnetic fields may also pass through window 58 or other dielectric housing structures, so capacitance measurements for a proximity sensor may be made through antenna window 58 or other dielectric housing structures, if desired.

With one suitable arrangement, housing 12 may be formed from a metal such as aluminum. Portions of housing 12 in the vicinity of antenna window 58 may be used as antenna ground. Antenna window 58 may be formed from a dielectric material such as polycarbonate (PC), acrylonitrile butadiene styrene (ABS), a PC/ABS blend, or other plastics (as examples). Window 58 may be attached to housing 12 using adhesive, fasteners, or other suitable attachment mechanisms. To ensure that device 10 has an attractive appearance, it may be desirable to form window 58 so that the exterior surfaces of window 58 conform to the edge profile exhibited by housing 12 in other portions of device 10. For example, if housing 12 has straight edges 12A and a flat bottom surface, window 58 may be formed with a right-angle bend and vertical sidewalls. If housing 12 has curved edges 12A, window 58 may have a similarly curved exterior surface along the edge of device 10.

Figure 2:
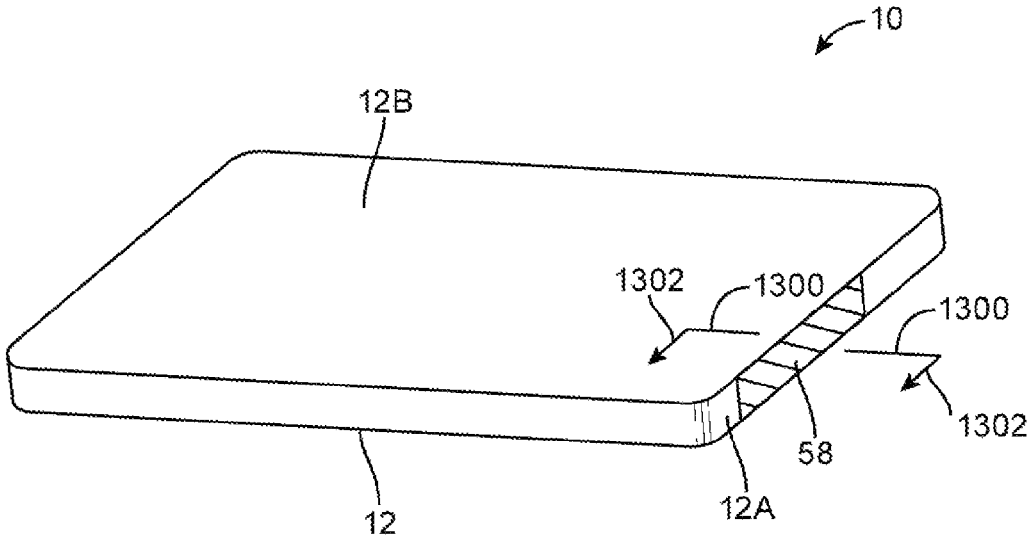
FIG. 2 is a rear perspective view of an illustrative electronic device such as the electronic device of FIG. 1 in accordance with an embodiment of the present invention.

FIG. 2 is a rear perspective view of device 10 of FIG. 1 showing how device 10 may have a relatively planar rear surface 12B and showing how antenna window 58 may be rectangular in shape with portions that match the shape of housing edges 12A. Antenna window 58 may have curved walls, planar walls, or walls of other shapes, if desired. Display 50 may be mounted on the opposing front surface of housing 12 of device 10.

Figure 3:
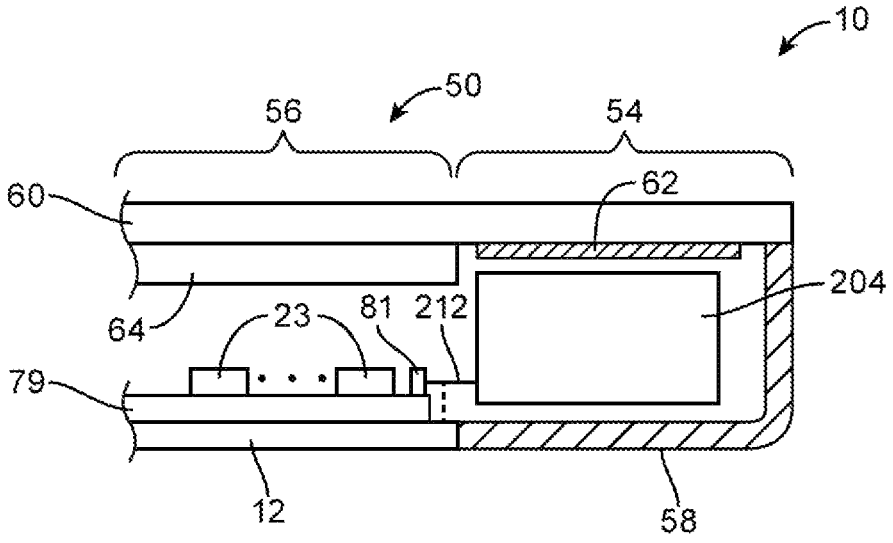
FIG. 3 is a cross-sectional side view of a portion of an electronic device having antenna structures in accordance with an embodiment of the present invention.

A cross-sectional view of device 10 taken along line 1300 of FIG. 2 and viewed in direction 1302 is shown in FIG. 3. As shown in FIG. 3, antenna structures 204 may be mounted within device 10 in the vicinity of antenna window 58. Structures 204 may include conductive material that serves as an antenna resonating element for an antenna. The antenna may be fed using transmission line 212. Transmission line 212 may have a positive signal conductor that is coupled to a positive antenna feed terminal (e.g., a feed terminal associated with a metal antenna resonating element trace on a dielectric support in structures 204) and a ground signal conductor that is coupled to a ground antenna feed terminal (i.e., antenna ground formed from conductive ground traces on a dielectric carrier in antenna structures 204 and/or grounded structures such as grounded portions of housing 12).

The antenna resonating element formed from structures 204 may be based on any suitable antenna resonating element design (e.g., structures 204 may form a patch antenna resonating element, a single arm inverted-F antenna structure, a dual-arm inverted-F antenna structure, a three-arm inverted-F antenna structure, other suitable multi-arm or single arm inverted-F antenna structures, a closed and/or open slot antenna structure, a loop antenna structure, a monopole, a dipole, a planar inverted-F antenna structure, a hybrid of any two or more of these designs, etc.). Configurations in which antenna structures 204 form an inverted-F antenna are sometimes described herein as an example.

Housing 12 may serve as antenna ground for an antenna formed from structure 204 and/or other conductive structures within device 10 and antenna structures 204 may serve as ground (e.g., conductive components, traces on printed circuits, etc.).

Structures 204 may include patterned conductive structures such as patterned metal structures. The patterned conductive structures may, if desired, be supported by a dielectric carrier. The conductive structures may be formed from a coating, from metal traces on a flexible printed circuit, or from metal traces formed on a plastic carrier using laser-processing techniques or other patterning techniques. Structures 204 may also be formed from stamped metal foil or other metal structures. In configurations for antenna structures 204 that include a dielectric carrier, metal layers may be formed directly on the surface of the dielectric carrier and/or a flexible printed circuit that includes patterned metal traces may be attached to the surface of the dielectric carrier. If desired, conductive material in structures 204 may also form one or more proximity sensor capacitor electrodes.

During operation of the antenna formed from structures 204, radio-frequency antenna signals can be conveyed through dielectric window 58. Radio-frequency antenna signals associated with structures 204 may also be conveyed through a display cover member such as cover layer 60. Display cover layer 60 may be formed from one or more clear layers of glass, plastic, or other materials. Display 50 may have an active region such as region 56 in which cover layer 60 has underlying conductive structure such as display module 64. The structures in display module 64 such as touch sensor electrodes and active display pixel circuitry may be conductive and may therefore attenuate radio-frequency signals. In region 54, however, display 50 may be inactive (i.e., module 64 may be absent). An opaque masking layer such as plastic or ink 62 may be formed on the underside of transparent cover glass 60 in region 54 to block antenna structures 204 from view by a user of device 10. Opaque material 62 and the dielectric material of cover layer 60 in region 54 may be sufficiently transparent to radio-frequency signals that radio-frequency signals can be conveyed through these structures during operation of device 10.

Device 10 may include one or more internal electrical components such as components 23. Components 23 may include storage and processing circuitry such as microprocessors, digital signal processors, application specific integrated circuits, memory chips, and other control circuitry. Components 23 may be mounted on one or more substrates such as substrate 79 (e.g., rigid printed circuit boards such as boards formed from fiberglass-filled epoxy, flexible printed circuits, molded plastic substrates, etc.). Components 23 may include input-output circuitry such as sensor circuitry (e.g., capacitive proximity sensor circuitry), wireless circuitry such as radio-frequency transceiver circuitry (e.g., circuitry for cellular telephone communications, wireless local area network communications, satellite navigation system communications, near field communications, and other wireless communications), amplifier circuitry, and other circuits. Connectors such as connector 81 may be used in interconnecting circuitry 23 to communications paths such as transmission line path 212.

Conductive structures for antenna structures 204 may be supported by a dielectric carrier. Antenna structures 204 may, for example, have conductive structures such as metal structures that are supported by a solid plastic member, a hollow plastic member, or other dielectric carrier structures. The conductive structures may be metal traces that are formed on the surface of a dielectric carrier using laser-based deposition techniques, physical vapor deposition techniques, electrochemical deposition, blanket metal deposition followed by photolithographic patterning, ink-jet printing deposition techniques, etc. The conductive structures may also be metal traces that are formed on a rigid printed circuit board (e.g., a printed circuit board formed from a substrate such as fiberglass-filled epoxy), metal traces that are formed on a flexible printed circuit (e.g., a printed circuit formed from a layer of polyimide or a sheet of other polymer) that is mounted on a dielectric carrier (e.g., a carrier formed from molded plastic or other material), may be other metal structures supported by a carrier (e.g., patterned metal foil), or may be other conductive structures.

Dielectric carriers for supporting metal antenna traces or a flexible printed circuit or other structure that includes metal antenna traces may be formed from a dielectric material such as glass, ceramic, or plastic. As an example, a dielectric carrier for antenna(s) in device 10 may be formed from plastic parts that are molded and/or machined into a desired shape such as a rectangular prism shape (rectangular box shape), a three-dimensional solid shape with one or more curved surfaces (e.g., a box shape with a curved outer surface that matches a corresponding curved housing edge 12A), or other shapes. In general, dielectric carrier shapes such as box or prism shapes with different numbers of sides and/or one or more curved surfaces or other three-dimensional carrier shapes may be used for antenna structures 204. The illustrative configuration of FIG. 3 in which antenna structures 204 have a rectangular cross-sectional shape is merely illustrative.

Figure 4:
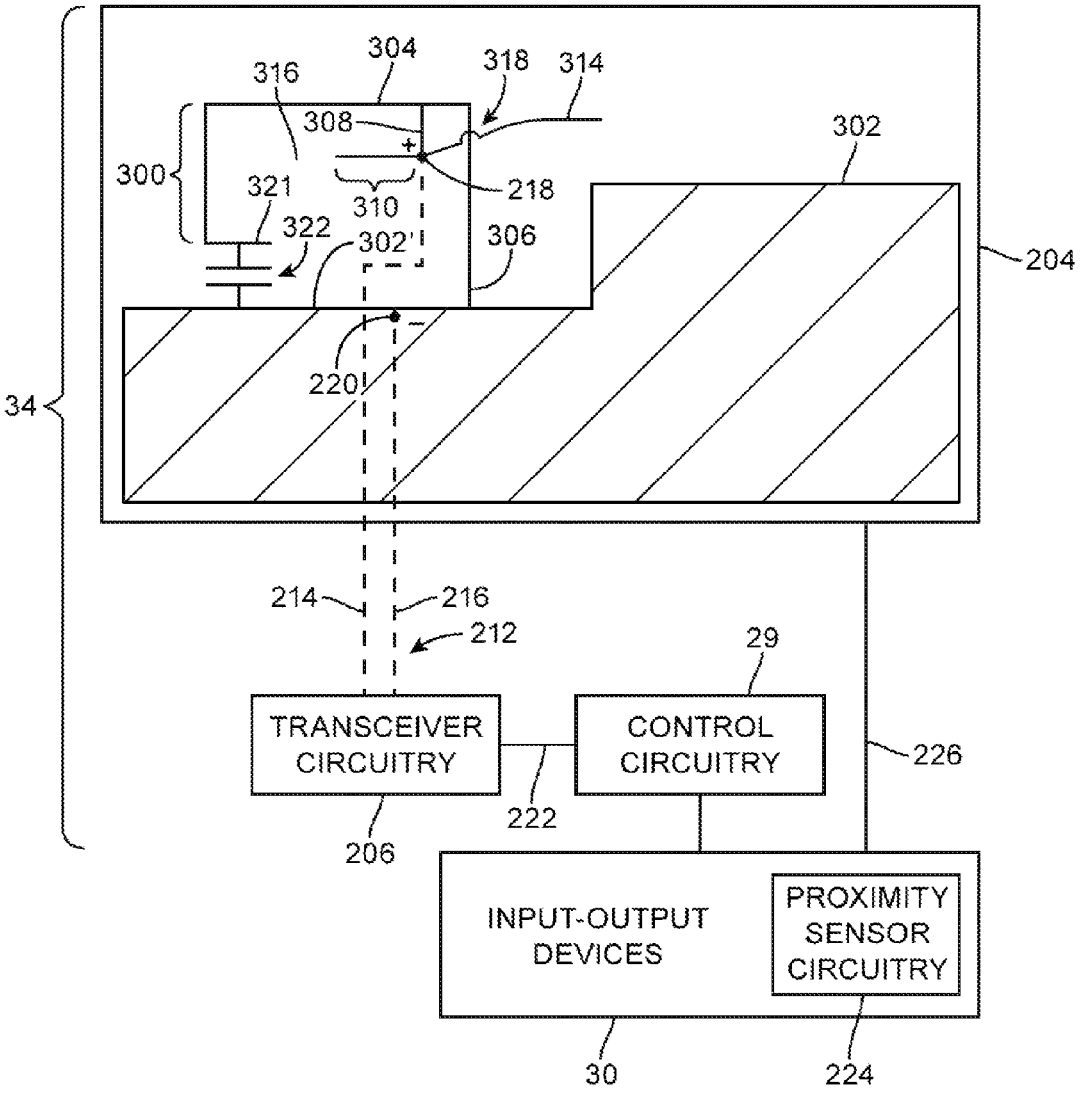
FIG. 4 is a diagram of illustrative antenna structures and other wireless circuitry in accordance with an embodiment of the present invention.

A diagram of an illustrative configuration that may be used for electronic device 10 is shown in FIG. 4. As shown in FIG. 4, electronic device 10 may include control circuitry 29. Control circuitry 29 may include storage and processing circuitry for controlling the operation of device 10. Control circuitry 29 may, for example, include storage such as hard disk drive storage, nonvolatile memory (e.g., flash memory or other electrically-programmable-read-only memory configured to form a solid state drive), volatile memory (e.g., static or dynamic random-access-memory), etc. Control circuitry 29 may include processing circuitry based on one or more microprocessors, microcontrollers, digital signal processors, baseband processors, power management units, audio codec chips, application specific integrated circuits, etc.

Control circuitry 29 may be used to run software on device 10, such as operating system software and application software. Using this software, control circuitry 29 may, for example, transmit and receive wireless data, tune antennas to cover communications bands of interest, and perform other functions related to the operation of device 10.

Input-output devices 30 may be used to allow data to be supplied to device 10 and to allow data to be provided from device 10 to external devices. Input-output circuitry 30 may include communications circuitry such as wired communications circuitry. Device 10 may also use wireless circuitry such as transceiver circuitry 206 and antenna structures 204 to communicate over one or more wireless communications bands.

Input-output devices 30 may also include input-output components with which a user can control the operation of device 10. A user may, for example, supply commands through input-output devices 30 and may receive status information and other output from device 10 using the output resources of input-output devices 30.

Input-output devices 30 may include proximity sensor circuitry 224 such as capacitive proximity sensor circuitry that uses portions of antenna structures 204 or other conductive structures in device 10 as capacitive proximity sensor electrodes. Proximity sensor circuitry 224 may be coupled to proximity sensor electrode structures in antenna structures 204 or elsewhere in device 10 using paths such as path 226. A capacitive proximity sensor may, for example, be used to determine when a user's body or other external object is in the vicinity of antenna structures 204. Proximity sensors for device 10 may also be formed using light-based proximity sensor structures, acoustic proximity sensor structures, etc.

Input-output devices 30 may also include sensors and status indicators such as an ambient light sensor, a temperature sensor, a pressure sensor, a magnetic sensor, an accelerometer, and light-emitting diodes and other components for gathering information about the environment in which device 10 is operating and providing information to a user of device 10 about the status of device 10. Audio components in devices 30 may include speakers and tone generators for presenting sound to a user of device 10 and microphones for gathering user audio input.

Devices 30 may include one or more displays such as display 50 of FIG. 1. Displays may be used to present images for a user such as text, video, and still images. Sensors in devices 30 may include a touch sensor array that is formed as one of the layers in display 14. During operation, user input may be gathered using buttons and other input-output components in devices 30 such as touch pad sensors, buttons, joysticks, click wheels, scrolling wheels, touch sensors such as a touch sensor array in a touch screen display or a touch pad, key pads, keyboards, vibrators, cameras, and other input-output components.

Wireless communications circuitry 34 may include radio-frequency (RF) transceiver circuitry such as transceiver circuitry 206 that is formed from one or more integrated circuits, power amplifier circuitry, low-noise input amplifiers, passive RF components, one or more antennas such as antenna structures 204, and other circuitry for handling RF wireless signals. Wireless signals can also be sent using light (e.g., using infrared communications).

Wireless communications circuitry 34 may include radio-frequency transceiver circuits for handling multiple radio-frequency communications bands. For example, circuitry 34 may include transceiver circuitry 206 for handling cellular telephone communications, wireless local area network signals, and satellite navigation system signals such as signals at 1575 MHz from satellites associated with the Global Positioning System. Transceiver circuitry 206 may handle 2.4 GHz and 5 GHz bands for WiFi® (IEEE 802.11) communications or other wireless local area network communications and may handle the 2.4 GHz Bluetooth® communications band. Circuitry 206 may use cellular telephone transceiver circuitry for handling wireless communications in cellular telephone bands such as the bands in the range of 700 MHz to 2700 MHz (as examples).

Wireless communications circuitry 34 can include circuitry for other short-range and long-range wireless links if desired. For example, wireless communications circuitry 34 may include wireless circuitry for receiving radio and television signals, paging circuits, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles. Wireless communications circuitry 34 may also include circuitry for handing near field communications.

Wireless communications circuitry 34 may include antenna structures 204. Antenna structures 204 may include one or more antennas. Antenna structures 204 may include inverted-F antennas, patch antennas, loop antennas, monopoles, dipoles, single-band antennas, dual-band antennas, tri-band or quad-band antennas, other antennas that cover more than two bands, or other suitable antennas. Configurations such as the illustrative configuration of FIG. 4 in which at least one antenna in device 10 is formed from an inverted-F antenna structure such as a multiband inverted-F antenna are sometimes described herein as an example.

If desired, antenna structures 204 may be provided with one or more tunable components or other tunable circuitry. Discrete components such as capacitors, inductors, and resistors may be incorporated into the tunable circuitry. Capacitive structures, inductive structures, and resistive structures may also be formed from patterned metal structures (e.g., part of an antenna). Tunable circuitry in antenna structures 204 may be controlled by control signals from control circuitry 29. For example, control circuitry 29 may supply control signals to tunable circuitry via one or more control paths during operation of device 10 whenever it is desired to tune antenna structures 204 to cover a desired communications band. Path 222 may be used to convey data between control circuitry 29 and wireless communications circuitry 34 (e.g., when transmitting wireless data or when receiving and processing wireless data).

Transceiver circuitry 206 may be coupled to antenna structures 204 by signal paths such as signal path 212. Signal path 212 may include one or more transmission lines. As an example, signal path 212 of FIG. 4 may be a transmission line having a positive signal conductor such as line 214 and a ground signal conductor such as line 216. Lines 214 and 216 may form parts of a coaxial cable or a microstrip transmission line (as examples). A matching network formed from components such as inductors, resistors, and capacitors may be used in matching the impedance of antenna structures 204 to the impedance of transmission line 212. Matching network components may be provided as discrete components (e.g., surface mount technology components) or may be formed from housing structures, printed circuit board structures, traces on plastic supports, etc. Components such as these may also be used in forming fixed circuit elements such as a fixed capacitor coupled to an antenna resonating element trace in antenna structures 204 and/or a tunable element such as a tunable capacitor or other tunable circuitry in antenna structures 204.

Transmission line 212 may be coupled to antenna feed structures associated with antenna structures 204. As an example, antenna structures 204 may form an inverted-F antenna having an antenna feed with a positive antenna feed terminal such as terminal 218 and a ground antenna feed terminal such as ground antenna feed terminal 220. Positive transmission line conductor 214 may be coupled to positive antenna feed terminal 218 and ground transmission line conductor 216 may be coupled to ground antenna feed terminal 220. Other types of antenna feed arrangements may be used if desired. The illustrative feeding configuration of FIG. 4 is merely illustrative.

Fixed and tunable circuitry in antenna structures 204 may be formed from one or more fixed and tunable circuits such as circuits based on capacitors, resistors, inductors, and switches. Fixed and tunable circuitry in antenna structures 204 may be implemented using discrete components mounted to a printed circuit such as a rigid printed circuit board (e.g., a printed circuit board formed from glass-filled epoxy) or a flexible printed circuit formed from a sheet of polyimide or a layer of other flexible polymer, a plastic carrier, a glass carrier, a ceramic carrier, or other dielectric substrate. As an example, fixed and/or tunable circuitry in antenna structures 204 may be coupled to a dielectric carrier of the type that may be used in supporting antenna resonating element traces for antenna structures 204 (FIG. 3). If desired, antenna structures 204 may omit tunable circuitry (i.e., antenna structures 204 may be implemented using only fixed components).

In the example of FIG. 4, antenna structures 204 form a multiband inverted-F antenna. Inverted-F antenna 204 has inverted-F antenna resonating element 300 and antenna ground 302. Inverted-F antenna resonating element 300 has three arms that help antenna 204 cover four communications bands. The four communications bands may include a low communications band (sometimes referred to as low band LB), a middle communications band (sometimes referred to as middle band MB), a high communications band (sometimes referred to as high band HB), and an upper communications band (sometimes referred to as upper or top band TB). Low band LB may cover frequencies in the range of 700 MHz to 960 MHz or other suitable frequency range. Middle band MB may cover frequencies in the range of 1710 MHz to 2170 MHz or other suitable frequency range. High band HB may cover frequencies in the range of 2300 MHz to 2700 MHz or other suitable frequency range. The frequencies associated with low band LB and middle band MB may be cellular telephone frequencies (as an example). The frequencies associated with high band HB may be cellular telephone frequencies and/or frequencies from 2400 MHz to 2480 MHz that are associated with 2.4 GHz IEEE 802.11 wireless local area network communications and/or Bluetooth signals (as examples). Upper band TB may cover frequencies in the range of 5150 MHz to 5850 MHz (e.g., 5 GHz IEEE 802.11 wireless local area network signals).

The three arms in inverted-F antenna resonating element 300 include arms 304, 312, and 310. Arm 304 is the longest of the three arms in element 300. Arm 312 is shorter than arm 304 and longer than arm 310. Conductive path 308 may couple arm 304 to arms 310 and 312. Positive antenna feed terminal 218 may be coupled to path 308, arm 310, and arm 312 (via path 318) and may be coupled to arm 304 via the conductive structures of path portion 308 of resonating element 300. Antenna feed terminal 220 may be coupled to antenna ground 302 across dielectric opening 316.

Arm 304 includes a segment that runs parallel to edge 302' of antenna ground 302'. Optional electrical component 322

(e.g., a fixed or tunable capacitor) may be coupled between end 321 of arm 304 and ground 302 to help tune the frequency response of arm 304 and antenna 204.

The relatively long size of arm 304 allows arm 304 to exhibit a resonance in low band LB. Accordingly, arm 304 may sometimes be referred to as a low band arm in antenna resonating element 300. Arm 304 is also preferably configured so that a harmonic resonance (e.g., a second or higher order harmonic) lies within band HB. Because arm 304 exhibits a resonance in band HB as well as band LB, arm 304 may sometimes be referred to as a high band arm or a low and high band arm. The relatively short length of arm 310 allows arm 310 to exhibit an antenna resonance in upper band TB. Arm 310 is therefore sometimes referred to as an upper band arm. Arm 312 has a length that lies between the length of arm 304 and the length of arm 310. Arm 312 may support an antenna resonance in middle band MB and may therefore sometimes be referred to as a middle band arm of antenna resonating element 300. The size of arms 312, 304, and 314 can be independently configured to optimize performance in each of the multiple communications bands covered by antenna 204.

Antenna 204 may have a return path (sometimes referred to as a short circuit path) such as return path 306 that couples the resonating element to ground. As shown in FIG. 4, return path 306 may be coupled in parallel with the antenna feed formed form terminals 218 and 220 across dielectric opening (gap) 316 between resonating element arm 304 and antenna ground 302. Middle band arm 314 may be coupled to positive antenna feed terminal 218 and the other portions of antenna resonating element 300 by path (conductive line) 318. Path 318 may cross return path 306 without touching path 306 and may therefore sometimes be referred to as a crossover path or crossover line. As shown in FIG. 4, crossover path 318 may be angled at a non-zero angle with respect to return path 306 (i.e., crossover path 318 may cross over return path 306 at a non-zero, non-perpendicular angle relative to the dimension along which return path extends). Use of this type of diagonal crossover arrangement for path 318 may help to reduce electromagnetic coupling between path 318 and return path 306. The use of path 318 to couple middle band arm 314 directly to positive antenna feed terminal 218 without passing through arm 304 helps decouple arms 304 and 314 and therefore helps decouple the high band and middle band operating modes of antenna 204, allowing independent optimization of the portions of antenna 204 associated with high band and middle band performance.

Figure 5:
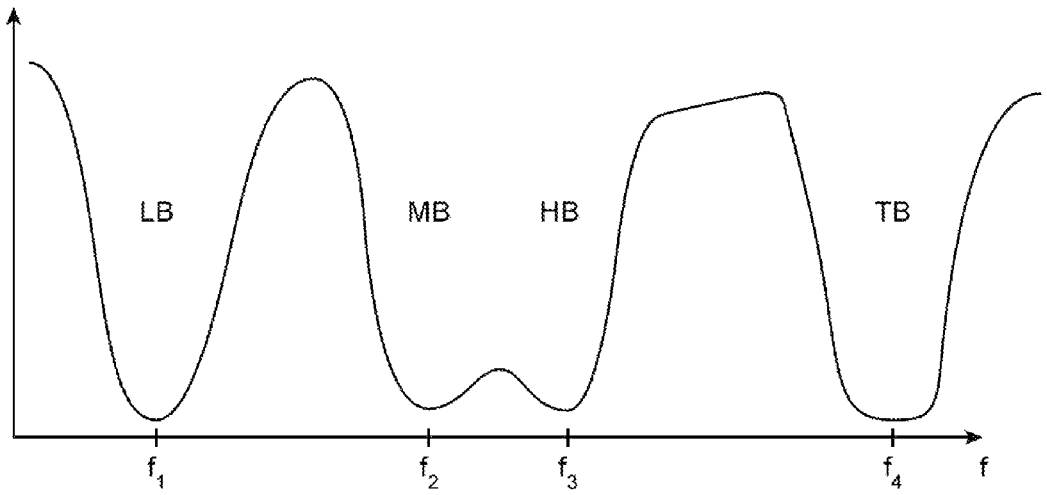
FIG. 5 is a graph in which antenna performance (standing wave ratio) has been plotted as a function of operating frequency in accordance with an embodiment of the present invention.

A graph in which antenna performance (i.e., standing wave ratio SWR) for antenna 204 has been plotted as a function of operating frequency f is shown in FIG. 5. As shown in FIG. 5, antenna 204 may exhibit four resonances, including low band resonance LB centered on frequency f1, middle band resonance MB centered on frequency f2, high band resonance HB centered on frequency f3, and upper band resonance UB centered on frequency f4. Because middle band arm 314 of antenna 204 is separate from high band arm 304, the middle band and high band modes of antenna 204 are substantially independent. This helps increase the bandwidth of the antenna resonances for bands MB and HB and allows independent adjustment of the positions of center frequencies f2 and f3.

Figure 6:
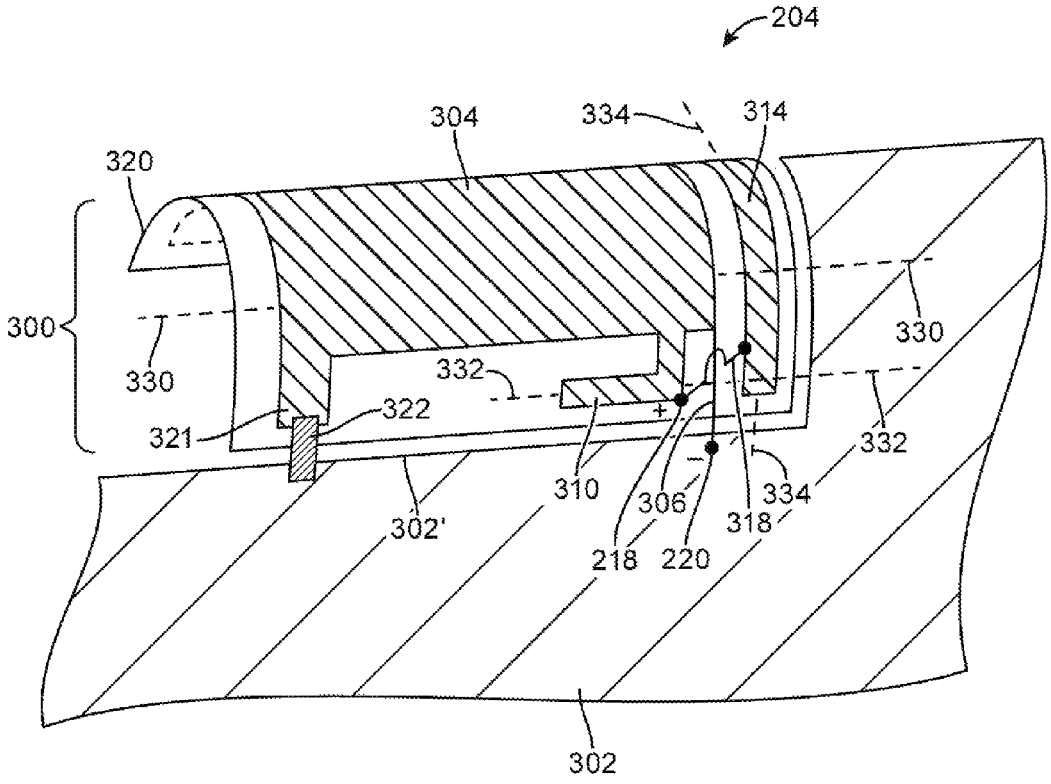
FIG. 6 is a perspective view of an illustrative antenna in accordance with an embodiment of the present invention.

FIG. 6 is a perspective view of illustrative structures that may be used in implementing antenna 204 of FIG. 5. In the example of FIG. 6, antenna 204 has been formed from conductive structure that include metal traces on dielectric support structure 320 (e.g., a flexible printed circuit mounted on a plastic carrier in a curved shape or other suitable shape, a plastic carrier for supporting metal traces, etc.). Component 322 may be a capacitor or other component that couples tip portion 321 of resonating element arm 304 to ground 302.

Arm 304 may be formed from metal traces on substrate 320 and may have an elongated shape that extends along longitudinal axis 330. Arm 310 may be formed from metal traces on carrier 320 (e.g., part of the same patterned metal layer that forms arm 304) and may have an elongated shape that extends along longitudinal axis 332 in parallel with arm 304. Middle band arm 314 may extend along line 334, perpendicular to arm 304 and perpendicular to arm 310. Substrate 320 may have a curved shape or other suitable shape and line 334 may bend by a corresponding amount (if desired). Other shapes for substrate 320 may be used, if desired.

Crossover path 318 may extend along an axis that lies at a non-zero and non-perpendicular angle with respect to the axis along which return path 306 extends. The metal traces that form middle band arm 314 may be patterned portions of the same metal trace layer on substrate 320 that is used in forming arms 304 and 310. Return path 306 and crossover path 318 may also be formed from metal traces on substrate 320. Antenna ground 302 may be formed form portions of housing 12 (e.g., metal housing portions) and/or printed circuit board traces or other conductive structures in device 10.

Figure 7:
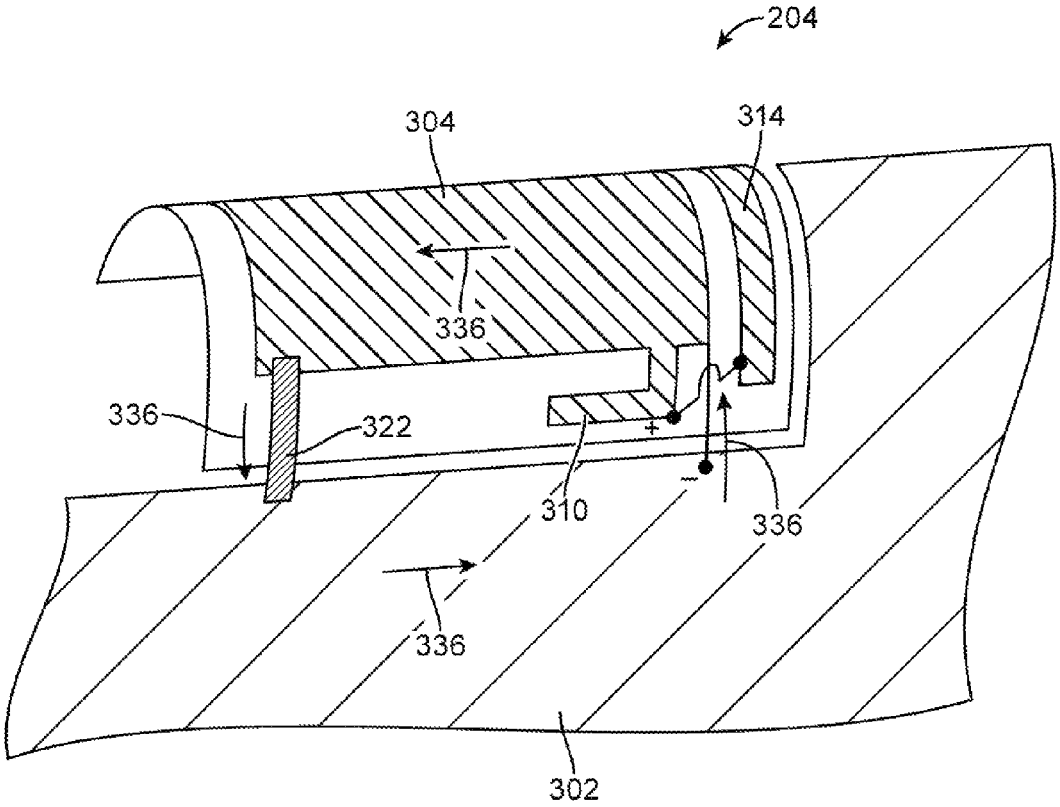
FIG. 7 is a perspective view of the antenna of FIG. 6 showing illustrative current flow patterns when operated at a low band frequency in accordance with an embodiment of the present invention.

FIG. 7 is a diagram of antenna 204 of FIG. 6 showing an illustrative current distribution that may be established when operating antenna 204 in a low band mode to cover low band LB at frequency f1 . As illustrated by currents 336, current primarily flows within low band arm 304 and ground 302 during operation of antenna 204 in the low band mode.

Figure 8:
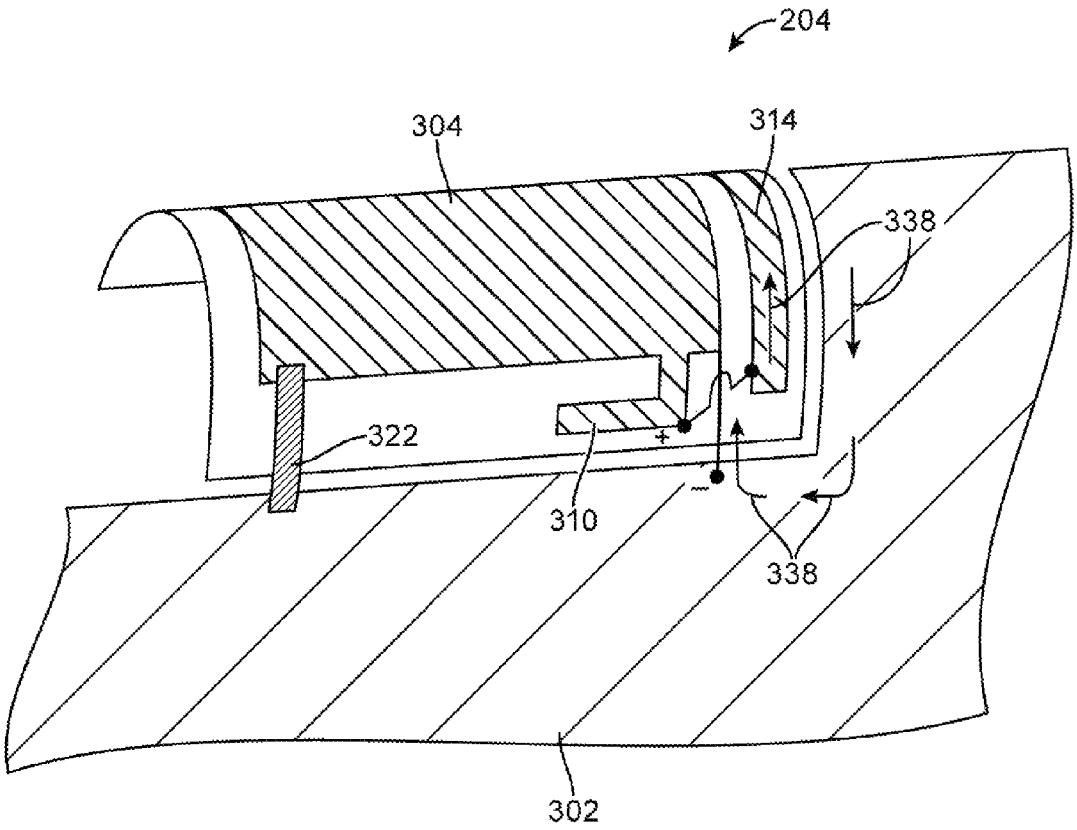
FIG. 8 is a perspective view of the antenna of FIG. 6 showing illustrative current flow patterns when operated at a middle band frequency in accordance with an embodiment of the present invention.

FIG. 8 is a diagram of antenna 204 of FIG. 6 showing an illustrative current distribution that may be established when operating antenna 204 in a middle band mode to cover middle band MB at frequency f2. As illustrated by currents 338, current primarily flows within middle band arm 314 and ground 302 during operation of antenna 204 in the middle band mode.

Figure 9:
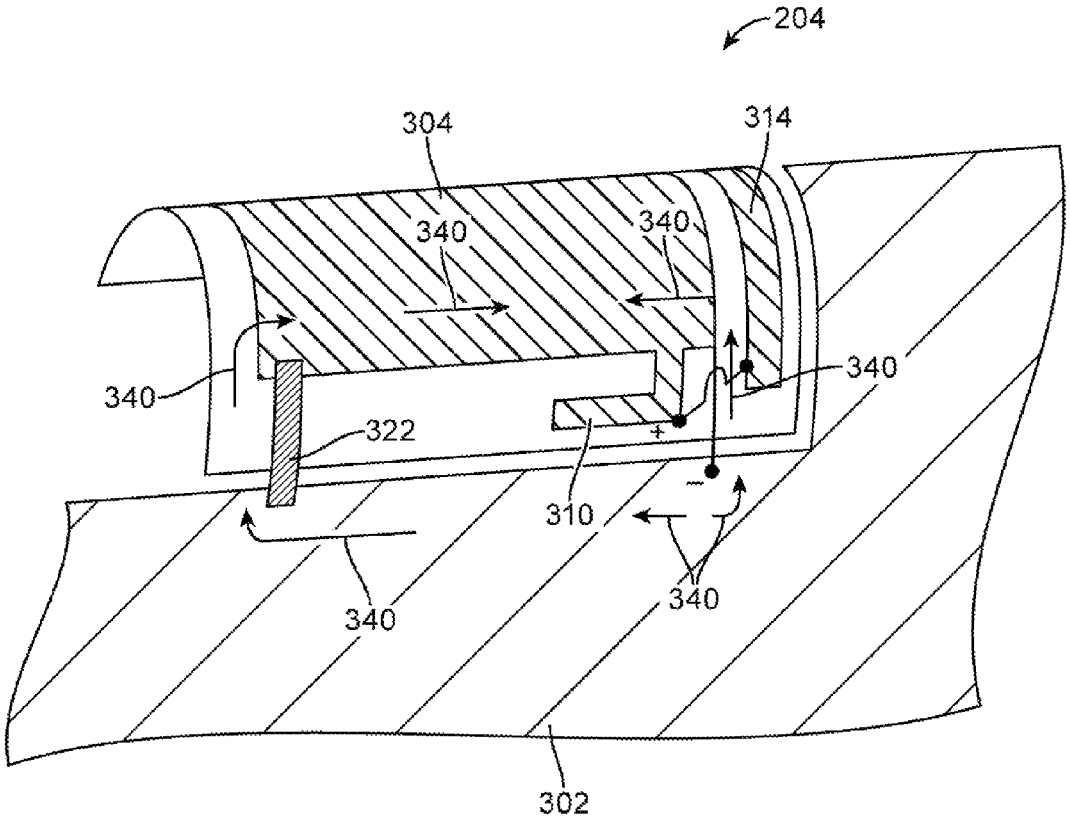
FIG. 9 is a perspective view of the antenna of FIG. 6 showing illustrative current flow patterns when operated at a high band frequency in accordance with an embodiment of the present invention.

FIG. 9 is a diagram of antenna 204 of FIG. 6 showing an illustrative current distribution that may be established when operating antenna 204 in a high band mode to cover high band HB at frequency f3. As illustrated by currents 340, current primarily flows within low and high band arm 304 and ground 302 (e.g., in a second order or higher harmonic pattern) during operation of antenna 204 in the high band mode.

Figure 10:
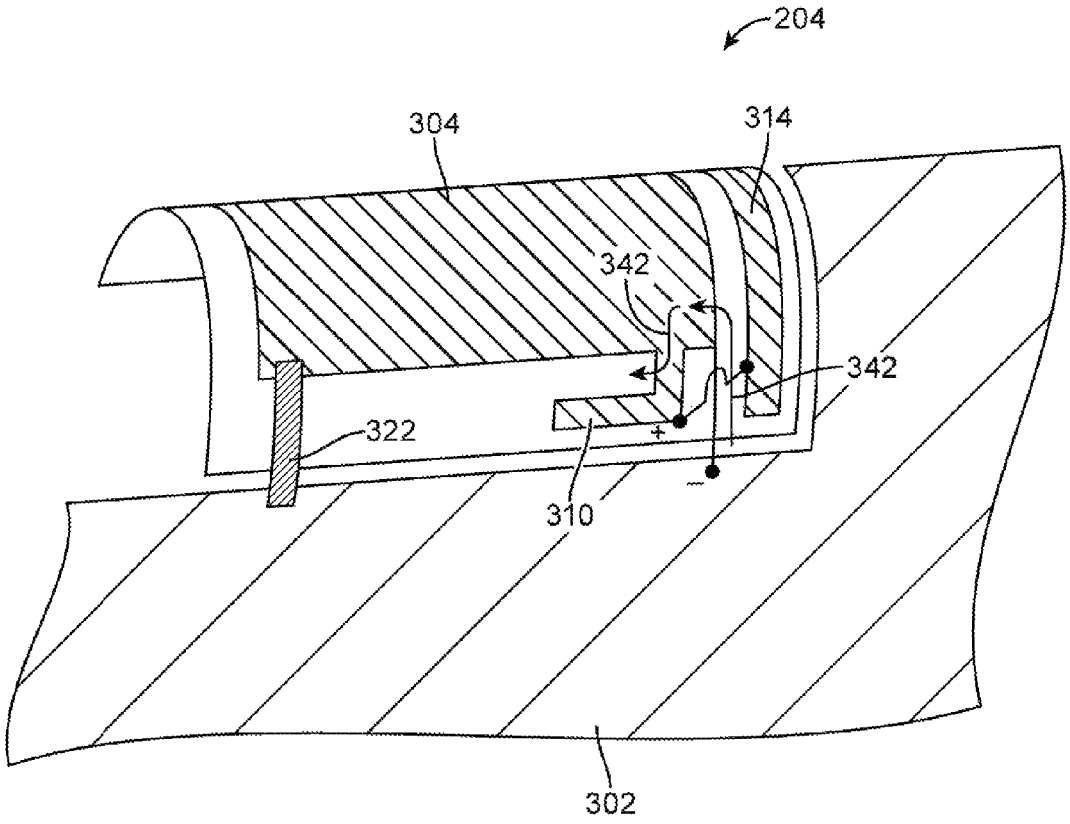
FIG. 10 is a perspective view of the antenna of FIG. 6 showing illustrative current flow patterns when operated at an upper band frequency above the high band frequency in accordance with an embodiment of the present invention.

FIG. 10 is a diagram of antenna 204 of FIG. 6 showing an illustrative current distribution that may be established when operating antenna 204 in an upper band mode to cover upper band TB at frequency f4. As illustrated by currents 342, current primarily flows within upper band arm 310 and ground 302 during operation of antenna 204 in the upper band mode.

When upper band TB is significantly higher in frequency than lower band LB, arm 310 will generally be significantly shorter than arm 304. The difference in size and resonant frequency between arms 304 and 310 allows arm 310 and arm 304 to be located on the same side of the antenna feed without producing interference between arms 304 and 310. As shown in FIG. 10, this lack of interference allows arm 310 to be located in the space between arm 304 and ground 302, which helps minimize the overall size of antenna 204.

Figure 11:
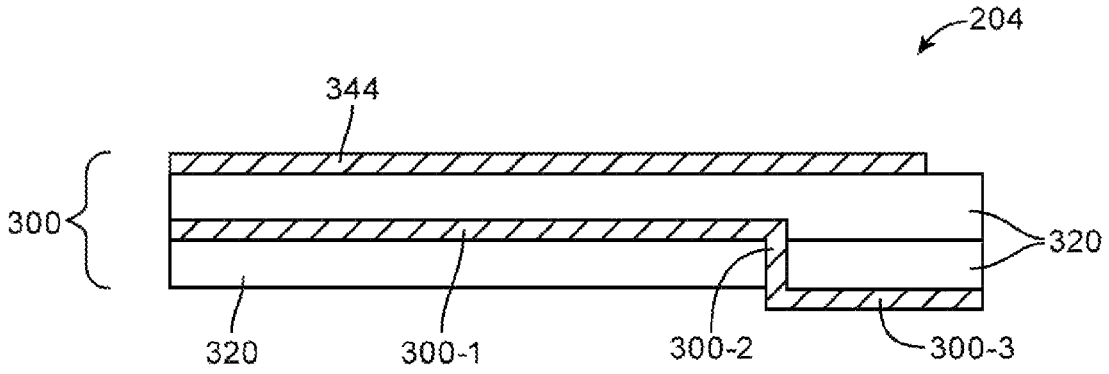
FIG. 11 is a cross-sectional side view of a portion of a flexible printed circuit of the type that may have metal antenna and proximity sensor electrode traces in accordance with an embodiment of the present invention.

FIG. 11 is a cross-sectional side view of antenna structures 204. As shown in FIG. 11, antenna structures 204 may be formed from metal traces on flexible printed circuit substrate 320 (e.g., a dielectric substrate layer such as a flexible printed circuit substrate formed from one or more polymer layers such as polyimide layers). Metal traces on substrate 320 may be used to form proximity sensor electrodes such as electrode 344. Electrode 344 may be formed form metal that is patterned identically or similarly to underlying metal in traces that make up antenna resonating element 300, thereby avoiding a situation in which the metal of electrode 344 adversely affects antenna performance of antenna resonating element 300. Electrode 344 may be electromagnetically coupled to other portions of antenna structures 204 and may therefore sometimes be considered to form a part of antenna structures 204.

Antenna resonating element 300 may be formed from multiple layers of metal traces on substrate 320 such as metal 300-1, metal 300-2, and metal 300-3. Metal 300-1 and metal 300-3 may be metal traces formed on one or more of the dielectric layers in substrate 320 (e.g., metal traces formed by photolithography or other suitable patterning techniques). Metal structures 300-2 may be vias or other vertical structures that interconnect metal traces in different layers of flexible printed circuit substrate 320. As an example, metal 300-1 may be used to form structures such as arms 304 and 310, path 308, and return path 306, metal 300-3 may be used in forming crossover path 318 and middle band arm 314, and metal 300-2 may be used in forming a connection (i.e., a via) between layers 300-1 and 300-3 at positive antenna feed terminal 218. In this type of configuration, metal in layer 300-3 that is associated with crossover path 318 may pass over metal in layer 300-1 that is associated with return path 306 (e.g., using a diagonal path configuration in which path 318 extends along an axis that is oriented at a non-zero and non-perpendicular angle with respect to the axis along which return path 306 extends).

The foregoing is merely illustrative of the principles of this invention and various modifications can be made by those skilled in the art without departing from the scope and spirit of the invention.

What is claimed is:

1. An inverted-F antenna operable in at least first, second, third, and fourth communications bands, comprising:

an antenna ground; and an antenna resonating element having a first arm that resonates in the first and third communications bands, a second arm that resonates in the second communications band, and a third arm that resonates in the fourth communications band and having a return path that couples the antenna resonating element to the antenna ground, wherein the antenna resonating element includes a crossover path that crosses the return path without contacting the return path.

2. The inverted-F antenna defined in claim 1 wherein the antenna resonating element further comprises a positive antenna feed terminal and a ground antenna feed terminal, wherein the crossover path has a first end that is coupled to the positive antenna feed terminal and a second end that is coupled to the second arm.

3. The inverted-F antenna defined in claim 2 wherein the antenna resonating element further comprises a flexible printed circuit substrate on which the antenna resonating element is formed, wherein the first arm and the crossover path are formed from metal traces on different layers of the flexible printed circuit substrate.

4. The inverted-F antenna defined in claim 3 wherein the return path extends along a first axis, wherein the crossover path is an elongated metal trace that extends along a second axis, and wherein the second axis lies at a non-zero angle with respect to the first axis.

5. The inverted-F antenna defined in claim 3 wherein the crossover path is configured to cross over the return path at a non-perpendicular angle.

6. The inverted-F antenna defined in claim 5 further comprising a capacitor that couples a portion of the first arm to the antenna ground.

7. The inverted-F antenna defined in claim 6 further comprising at least one capacitive proximity sensor electrode.

8. The inverted-F antenna defined in claim 1 wherein the crossover path has an end that is coupled to the second arm.

9. The inverted-F antenna defined in claim 8 wherein the crossover path has an opposing end that is coupled to the third arm.

10. The inverted-F antenna defined in claim 9 wherein the antenna ground comprises a portion of an electronic device housing.

11. The inverted-F antenna defined in claim 10 wherein the crossover path is configured to cross over the return path at a non-perpendicular angle.

12. The inverted-F antenna defined in claim 11 wherein the first communications band includes frequencies between 700 MHz and 960 MHz, wherein the first arm is configured to exhibit an antenna resonance at the frequencies between 700 MHz and 960 MHz, wherein the second communications band includes frequencies between 1710 MHz and 2170 MHz, wherein the second arm is configured to exhibit an antenna resonance at the frequencies between 1710 MHz and 2170 MHz, wherein the third communications band includes frequencies between 2300 MHz and 2700 MHz, wherein the first arm is configured to exhibit an antenna resonance at the frequencies between 2300 MHz and 2700 MHz, wherein the fourth communications band includes frequencies between 5150 MHz and 5850 MHz, and wherein the third arm is configured to exhibit an antenna resonance at the frequencies between 5150 MHz and 5850 MHz.

13. An inverted-F antenna operable in at least first, second, third, and fourth communications bands, comprising:

an antenna ground; and antenna resonating element having a first arm that resonates in the first and third communications bands, a second arm that resonates in the second communications band, and a third arm that resonates in the fourth communications band and having a return path that couples the antenna resonating element to the antenna ground, wherein the third arm is interposed between the first arm and the antenna ground and the second arm is interposed between the first arm and the antenna ground.

14. The inverted-F antenna defined in claim 13 wherein the first communications band includes frequencies between 700 MHz and 960 MHz and wherein the first arm is configured to exhibit an antenna resonance at the frequencies between 700 MHz and 960 MHz.

15. The inverted-F antenna defined in claim 14 wherein the second communications band includes frequencies between 1710 MHz and 2170 MHz and wherein the second arm is configured to exhibit an antenna resonance at the frequencies between 1710 MHz and 2170 MHz.

16. The inverted-F antenna defined in claim 15 wherein the third communications band includes frequencies between 2300 MHz and 2700 MHz and wherein the first arm is configured to exhibit an antenna resonance at the frequencies between 2300 MHz and 2700 MHz.

17. The inverted-F antenna defined in claim 16 wherein the fourth communications band includes frequencies between 5150 MHz and 5850 MHz and wherein the third arm is configured to exhibit an antenna resonance at the frequencies between 5150 MHz and 5850 MHz.

18. The inverted-F antenna defined in claim 17 wherein the antenna resonating element includes a crossover path coupled to the second arm and wherein the crossover path crosses the return path at a non-perpendicular angle without touching the return path.

19. An antenna comprising:

an antenna resonating element having first, second, and third arms, wherein the antenna resonating element is configured to exhibit antenna resonances in first, second, third, and fourth communications bands;

an antenna ground;

a return path that is coupled between the antenna resonating element and the antenna ground; and a crossover path that crosses the return path without touching the return path and that is coupled between the second and third arms.

20. The antenna defined in claim 19 wherein the third arm is configured to exhibit an antenna resonance at frequencies between 5150 MHz and 5850 MHz and wherein the third arm is between the first arm and the antenna ground.

* * * * *